United States Patent [19]

Che-Wei

[11] 4,058,858

[45] Nov. 22, 1977

[54] WATER STORAGE TANK FOR FLUSH TOILETS

[76] Inventor: Liao Che-Wei, No. 115, Chung-Yuan Road, Chung-li, Taiwan, China

[21] Appl. No.: 722,664

[22] Filed: Sept. 13, 1976

[51] Int. Cl.[2] ..... E03D 1/34

[52] U.S. Cl. ..... 4/67 R; 4/DIG. 3; 4/101

[58] Field of Search ..... 4/DIG. 3, 66, 67 R, 4/31, 38, 100, 101, 249; 137/624.11

[56] References Cited

U.S. PATENT DOCUMENTS

| | | | |
|---|---|---|---|
| 2,181,422 | 11/1939 | Gawan | 4/101 X |
| 2,185,394 | 1/1940 | Arbogast | 4/DIG. 3 X |
| 2,552,625 | 5/1951 | Filliung | 4/DIG. 3 X |
| 2,591,975 | 4/1952 | Southwick | 4/67 R X |
| 3,304,559 | 2/1967 | Frankel et al. | 4/100 |
| 3,334,359 | 8/1967 | Weingartner | 4/100 X |
| 3,431,564 | 3/1969 | Davies | 4/67 R X |

*Primary Examiner*—Charles E. Phillips
*Attorney, Agent, or Firm*—J. Harold Nissen

[57] ABSTRACT

A water storge tank used in a flush toilet is disclosed wherein a timer is provided on the tank for manually adjusting the flush time to automatically control the volume of water required for flush purpose. And the contact area between a closure member and an outlet tube of the tank is made linear to reduce wearing therebetween and prevent water leakage.

10 Claims, 4 Drawing Figures

WATER STORAGE TANK FOR FLUSH TOILETS

BACKGROUND OF THE INVENTION

Several toilet structures have been known in the art. The difficulty with most conventional toilets of the type using water storage tank is that once a knob of the tank is operated to introduce water into the toilet bowl, the flush operation will not stop until all the water in the tank is used up. Quite often this is kind of waste, especially in those countries where water supply is in shortage. Also known is a toilet structure which is so designed that after flush operation is started by pressing a knob of the tank, the operation will not stop until the knob is released. In this way, one can control the volume of water required for flush purpose by pressing the knob for a desired period of time. However, this is obviously inconvenient for the user because he has to keep pressing the knob throughout the flush operation.

Another serious problem with conventional flush toilets is that the closure member for sealing the water in the water storage tank is planarly in contact with the outlet of the tank and thus will be worn out after a short period of time, thus causing undesirable water leakage from the tank into the toilet bowl.

SUMMARY OF THE INVENTION

In view of the foregoing, one important object of the present invention is to provide a water tank structure for the flush toilet wherein a manually adjustable timer is adopted in connection with the tank to automatically control the flush period of the toilet.

Another object of the present invention is to provide a water tank structure for the flush toilet wherein the contact area between the closure member and the outlet tube of the tank is substantially reduced to avoid wearing and guarantee a leakage-free water tank.

Additional objects and advantages of the present invention will appear after the description hereinafter set forth is considered in conjunction with the drawings annexed hereto.

DETAILED DESCRIPTION OF THE PREFERRED EMBODIMENT

This invention relates to a flush toilet structure, and more particularly to a water storage tank structure having a manually adjustable timer for arbitrarily selecting a desirable flush duration, and a closure member contacting the outlet tube of the tank on a reduced area for minimizing wearing therebetween and improve sealing effect of the closure member.

Figure 1:
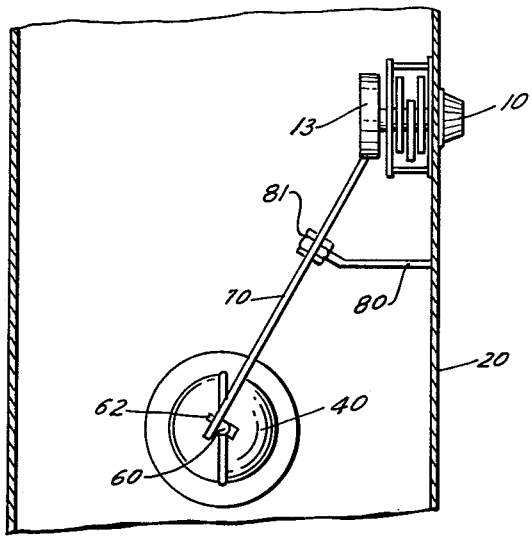
FIG. 1 shows a top sectional view of the water storage tank in accordance with the present invention.
Figure 2:
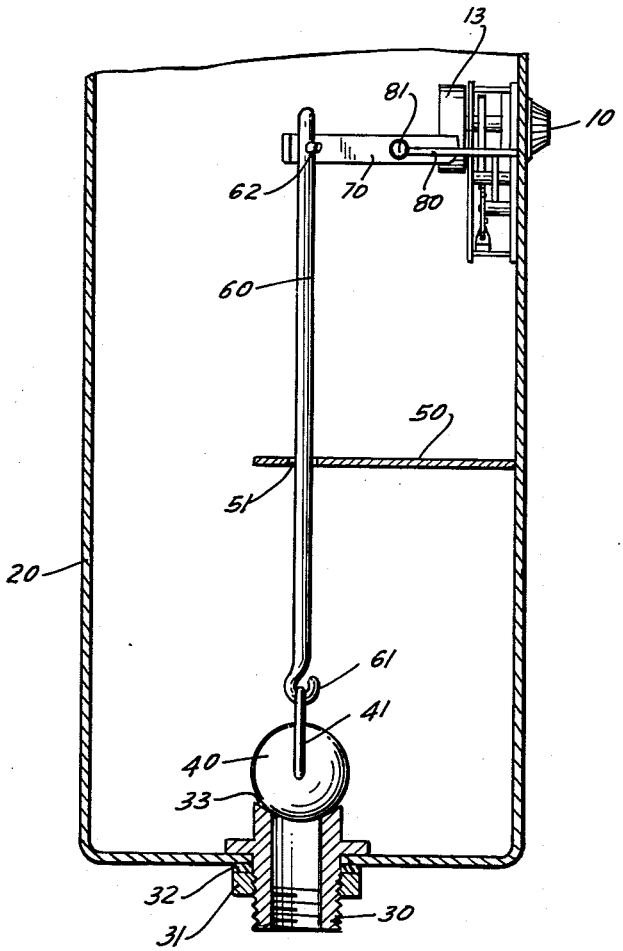
FIG. 2 shows a side sectional view of the water storage tank in accordance with the present invention.

Refer to FIGS. 1 and 2, which show respectively the top and side sectional views of the water storage tank according to the present invention. A timer 10 is installed on the side wall of the water tank 20 for manually selecting a desired flush period of time. A lever 70 supported at one end by an arm 80 at point 81 is drivable by the timer 10 through a cam 13. The other end of the lever 70 is pivoted on a vertical bar 60 through a pin 62. The bar 60 passes through an aperture 51 formed on a plate 50 to avoid undesirable swing of the bar 60. The lower end of the bar is formed into a hook 61 which is used to hold a closure member 40 through a ring 41 or the like. The closure member 40 is in the form of a metal ball with rubber coated thereon to increase the weight thereof. An outlet tube 30 is secured to the bottom of the tank 20 by means of nut 31 and washer 32. The peripheral wall 33 at the upper end of the outlet tube is tapered so that when the flush toilet is not in operation, the closure member 40 contacts the upper end of the tube on a horizontal circle, instead of a plane as is the case in the conventional water tanks, whereby to substantially reduce the contact area therebetween. In this manner, wearing between the closure member and the outlet tube is minimized, and perfect sealing of the water tank is achieved.

In use, one first rotates a spring 11 (shown in FIGS. 3 and 4) on the timer 10 to a certain extent depending on the amount of water to be introduced into the toilet bowl, the lever 70 is then pressed by the cam 13, thus lifting the bar 60 to open the outlet tube. Water enters toilet bowl from the tank and flushes the toilet. After a period of time predetermined by the user, the bar 60 lowers to seal the outlet tube with the closure member 40. The construction of the timer 10 will be detailed hereinbelow.

Figure 3:
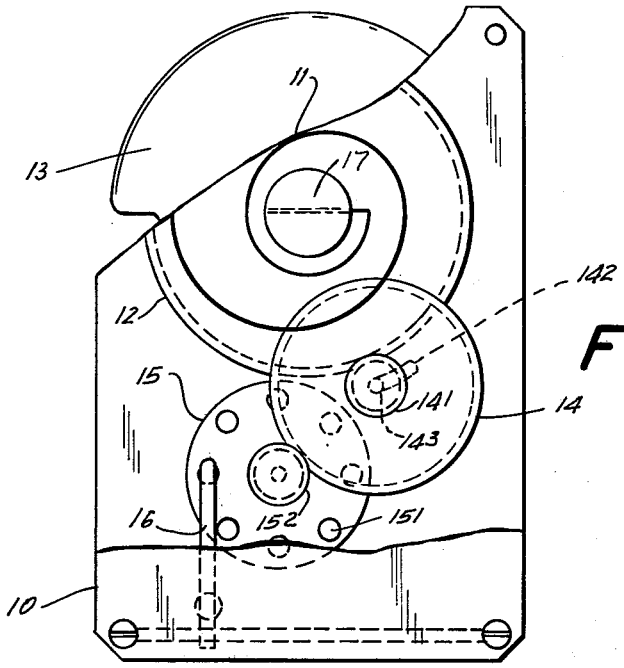
FIG. 3 shows a front view of a timer associated with the water tank in accordance with the present invention, wherein part of the timer is removed to show a cam.
Figure 4:
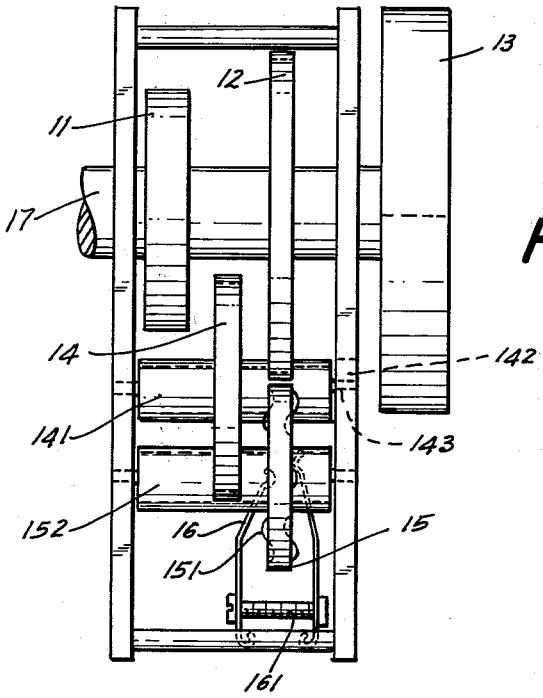
FIG. 4 shows a side view of the timer shown in FIG. 3.

FIGS. 3 & 4 show the front and side views of the timer 10 according to the present invention. Shaft 17 upon which spring 11, cam 13 and transmission gear 12 are mounted is manually rotatable by an external force applied on the timer for setting a desired flush time. When the shaft 17 is rotated counterclockwise through an angle corresponding to the desired flush time, the spring 11 is wound up and the cam 13 is rotated counterclockwise to press one end of the lever 70 (shown in FIGS. 1 and 2). The vertical bar 60 is then lifted up to remove the closure member 40 from its sealing position. In the meantime, the transmission gear 12 which is engaged with a pinion 141 mounted on an axis 143 of an idle wheel 14 is caused to rotate through an angle. The idle wheel 14 is normally meshed with an escape wheel 15 through a pinion 152. Since the gear 12 is engaged with the pinion 141 at a position close to one end of the axis 143, when the gear is rotated the axis 143 will be moved along a preformed groove 142 to disengage the idler 14 from the escape wheel 15. The groove 142 is in the form of an arc concentric with the gear 12, as shown in FIG. 3.

When the external force is released, the restitution force of the spring 11 forces the gear 12 to rotate clockwise and thus pushes the idler 14 back to its original position. The idler is then meshed with the pinion 152 of the escape wheel 15 again, and both are caused into rotation. The surface of the escape wheel is alternatively made concave and convex as designated by 151 in FIGS. 3 and 4. The escape wheel 15 runs at a relatively high speed because of the gear arrangements 12, 141, 14, 152. In order to reduce the speed of the escape wheel 15 and thus increase the restoring time of the spring 11 to thereby properly adjust the falling rate of the vertical bar 60 (in FIG. 2), a pair of clamps 16 are provided to frictionally contact the two opposite surfaces of the escape wheel 15. A screw 161 is used for adjusting the distance between the two clamps, and thus the friction between the clamps and the escape wheel. In this manner, the timer 10 cam can be properly scaled.

According to one embodiment of the present invention, the timer is so scaled that, with a maximum setting of twelve seconds, one second of the setting corresponds to one liter of water discharged into the toilet bowl. Table 1 shows a comparison between the flush toilet of the present invention and a conventional one having a water storage tank with a maximum capacity of twelve liters. It can be seen that the toilet according to the present invention can save water up to 70%.

The present invention consists in that the quantity of water to be used for flushing purpose can be arbitrarily and continuously adjusted. Another novel feature of the present invention is that it provides a closure member and an associated outlet tube structure so that the contact area therebetween is not planar but linear whereby to substantially minimize wearing and guarantee a reliable sealing.

It is to be understood that though a preferred embodiment of the present invention has been described by way of example hereinbefore, several changes or modifications are still possible without departing from the spirit and scope of the present invention.

Table 1

| Age | Total output per day | Number of Times per day (estimated) Urine | Stools | Conventional Water required each time | Water required per day | Present Invention Quantity of water for Urine | Quantity of water for stools | Quantity of water per day | Quantity of water saved per day | Percentage of water saved |
|---|---|---|---|---|---|---|---|---|---|---|
| 6–15 | 800–1500 | 6 | 1 | 12 l | 84 l | 3 l | 7 l | 25 l | 59 l | 70 % |
| Adults | 600–2500 c.c | 6 | 1 | 12 l | 84 l | 3.5 l | 10 l | 31 l | 53 l | 63.1 % |

What is claimed is:

1. Apparatus for controlling the quantity of water dispensed from a water storage tank to a flush toilet, comprising:

a water storage tank having a water discharge opening and a closure therefor;

a manually operable adjustable timer for setting a predetermined flush time related to said water discharge opening to dispense a predetermined required quantity to flush water from said water storage tank to the flush toilet, said predetermined required quantity of water being related to the item and quantity thereof to be removed from the flush toilet;

said manually operable timer including a rotatable shaft internal said tank and having a portion thereof extending external of said tank, a cam in said tank positioned on said shaft operatively connected with said connecting means, setting means connected with said shaft for setting the predetermined flush time, said setting means including settable spring means coupled with said shaft and means external of said tank coupled with said shaft for rotation thereof to set said spring for a predetermined flush time, transmission mechanism operatively connected between said settable spring means and said cam, and speed control means operatively connected with said transmission mechanism to control the rotating speed of said cam, and thereby to control the predetermined flush time; and, connecting means operatively associated with said timer and connected with said closure to remove said closure from said discharge opening to permit the water from said storage tank to enter the flush toilet for said predetermined flush time.

2. Apparatus as defined in claim 1, wherein said connecting means comprises:

a lifting bar having one end connected with said closure;

a guide member connected with said tank and having guide means, said lifting bar being movably coupled with said guide means for controlling the direction of movement of said closure member;

a lever including means at one end thereof for pivotally connecting said one end with the other end of said lifting bar, the other end of said lever being operatively associated with said timer; and, an arm having one end connected with said storage tank and another end supporting said lever to maintain said other end of said lever in said operative association with said timer.

3. Apparatus as defined in claim 1 wherein:

said transmission mechanism comprises a first pinion and a transmission gear meshed therewith, a guidepath in the form of a preformed groove, concentric with said transmission gear, said first pinion being connected with said groove for guiding the movement of the axis of said first pinion;

said speed control mechanism comprises an escape wheel, a second pinion and an idle wheel meshed therewith, said idle wheel being carried by said first pinion coaxial therewith, said escape wheel being carried by said second pinion coaxial therewith, said idle wheel being normally meshed with said escape wheel when said first pinion is in a first position of said groove and being disengaged from said escape wheel when said first pinion is in a second position of said groove responsive to the rotation of said transmission gear, release of said external means causes said first pinion to move to said first position of said groove restoring said idle wheel to its original position.

4. Apparatus as defined in claim 3, including:

means frictionally engaged with said escape wheel for reducing the rotating speed thereof.

5. Apparatus as defined in claim 4, wherein said frictional means includes:

a pair of clamps engageable with the sides of said escape wheel; and sealing means comprising an adjustable screw engageable with said clamps for adjusting the spacing therebetween.

6. Apparatus as defined in claim 5, wherein the sides of said escape wheel engageable by said clamps includes surfaces of alternate concave and convex curvature.

7. Apparatus as defined in claim 5, wherein said connecting means comprises:

a lifting bar having one end connected with said closure;

a guide member connected with said tank and having guide means, said lifting bar being movably coupled with said guide means for controlling the direction of movement of said closure member;

a lever including means at one end thereof for pivotally connecting said one end with the other end of said lifting bar, the other end of said lever being operatively connected with said cam; and, an arm having one end connected with said storage tank and another end supporting said lever to maintain said other end of said lever in said operative connection with said cam.

8. Apparatus as defined in claim 1, wherein said water discharge opening includes an outlet tube structure including a peripheral wall on the inside of said storage tank, said peripheral wall being tapered; and, said closure includes a spherical closure member for said outlet tube, said peripheral wall and said closure member having a linear contact therebetween in their closed condition.

9. Apparatus as defined in claim 8, wherein said closure member is a ball and in its closed condition is in contact with said tapered peripheral wall on a circle.

10. Apparatus as defined in claim 8, wherein said outlet tube is cylindrically shaped and includes means connecting said tube vertically to the bottom of the tank; and said closure member includes means to contact said peripheral wall on a horizontal circle in said closed condition.

* * * * *